US005315091A

United States Patent [19]

O'Brien et al.

[11] Patent Number: 5,315,091

[45] Date of Patent: May 24, 1994

[54] RESISTIVELY HEATED SAMPLE PREPARATION APPARATUS

[75] Inventors: Larry S. O'Brien; Gordon C. Ford, both of St. Joseph; Peter M. Willis, Benton Harbor; Robert S. Tate, South Haven, all of Mich.

[73] Assignee: Leco Corporation, St. Joseph, Mich.

[21] Appl. No.: 25,443

[22] Filed: Mar. 2, 1993

[51] Int. Cl.[5] ..... F27D 19/00; B22D 27/04

[52] U.S. Cl. ..... 219/385; 219/420; 373/118; 423/162; 423/156; 423/239; 266/276; 164/250.1; 164/335; 164/338.1; 164/136

[58] Field of Search ..... 219/385, 420, 424, 425, 219/421; 373/118, 115; 432/162, 156, 157, 243, 239; 266/276, 275, 242; 65/335, 361, 347; 164/335, 136, 338.1, 250.1, 4.1, 48, 492

[56] References Cited

U.S. PATENT DOCUMENTS

| | | | |
|---|---|---|---|
| 1,409,118 | 3/1922 | Scanlon | 432/239 |
| 2,425,725 | 8/1947 | Bonton et al. | 164/4.1 |
| 2,798,932 | 7/1957 | Evans . | |
| 2,804,777 | 9/1957 | Kerr-Lawson | 74/42 |
| 3,258,323 | 6/1966 | Kirk | 219/385 |
| 3,437,317 | 4/1969 | Micin | 259/75 |
| 3,451,794 | 6/1969 | Patterson | 65/18 |
| 3,619,839 | 11/1971 | Kraus et al. . | |
| 3,757,961 | 9/1973 | Jacobs | 214/1 BB |
| 3,890,089 | 6/1975 | Matocha | 432/11 |
| 3,936,587 | 2/1976 | Sitek et al. . | |
| 4,045,202 | 8/1977 | Claisse | 65/178 |
| 4,072,814 | 2/1978 | Boillot . | |
| 4,138,209 | 2/1979 | Bahr | 164/335 |
| 4,156,452 | 5/1979 | Sharkey | 164/335 |
| 4,175,610 | 11/1979 | Zauhar et al. | 164/335 |
| 4,317,560 | 3/1982 | Troyer | 266/48 |
| 4,328,386 | 5/1982 | Bredeweg | 373/118 |
| 4,329,136 | 5/1982 | Willay et al. | 425/174.8 |
| 4,419,754 | 12/1983 | Sitek et al. | 373/118 |
| 4,563,146 | 1/1986 | Kelly et al. | 425/256 |
| 4,579,523 | 4/1986 | Laiquddin et al. | 432/253 |
| 4,609,392 | 9/1986 | Claisse | 65/134 |
| 4,664,624 | 5/1987 | Dufresne | 432/243 |
| 4,871,309 | 10/1989 | Chapman | 432/156 |
| 5,016,567 | 5/1991 | Iwabuchi et al. | 118/730 |
| 5,055,263 | 10/1991 | Meltzer | 422/65 |

FOREIGN PATENT DOCUMENTS

| | | | |
|---|---|---|---|
| 23693/88 | 2/1989 | Australia . | |
| 3025210 | 1/1982 | Fed. Rep. of Germany . | |
| 2248479 | 5/1975 | France . | |
| 487027 | 10/1975 | U.S.S.R. | 65/335 |
| 1517321 | 10/1978 | United Kingdom . | |

OTHER PUBLICATIONS

"Look to the Leader, in Claisse Fluxer-Bis!", Corporation Scientifique Claisse, Inc. (8 pages).

Instruction Manual for FX-100 and FX-200 available from Leco Corporation. pp. 5-7, copyright 1998.

*Primary Examiner*—Bruce A. Reynolds
*Assistant Examiner*—John A. Jeffery
*Attorney, Agent, or Firm*—Price, Heneveld, Cooper, DeWitt & Litton

[57] ABSTRACT

An electrical resistance heated oven is used to heat a crucible to melt a sample and to simultaneously heat a casting dish into which the molten sample can be poured. The oven is cooled with the crucible and casting dish within the oven in order to prepare a sample bead for analysis. In another embodiment of the invention the sample is again melted in a crucible and after melting the crucible is moved out of the oven and turned to pour the molten sample into an acid solution positioned external to the oven. The crucible and sample can be moved while in the oven to mix the sample. The method of preparing an analytical sample using the electrical resistance heated oven is also disclosed.

18 Claims, 3 Drawing Sheets

RESISTIVELY HEATED SAMPLE PREPARATION APPARATUS

BACKGROUND OF THE INVENTION

The present invention pertains to an apparatus and a method for the preparation of a sample bead for use in X-ray fluorescence spectroscopy or other analytical methods such as atomic absorption or inductively coupled plasma.

Several machines are commercially available which provide for the fusion and mixing of a powdered sample together with a flux to provide a solid glass-like sample bead or button for analysis by X-ray fluorescence spectroscopy or other analytical methods Samples to be analyzed include materials such as silicon dioxide, cement, aluminum dioxide, calcium dioxide, magnesium oxide and slag, which are analyzed for the content of their active elements. To provide a sample in a form which can be used in connection with such analysis technique, it must be formed into solid smooth-surfaced shape.

In the prior art systems, high melting temperatures are obtained utilizing a mixture of oxygen and propane which create an oxidizing environment which, at the high temperature, can seriously damage the platinum crucibles holding the sample. Further, with the use of pure oxygen and propane, excessive temperatures can be reached which actually can melt the platinum crucible.

Also, in the prior art systems, the devices poured the mixed molten sample or melt into a casting dish for subsequent cooling into the desired sample shape. However, the dishes typically are positioned adjacent the melting crucible and therefore the temperature of the dishes does not correspond closely to that of the crucible and during the pour step, a sample can cool in an uneven manner thereby crystallizing improperly and possibly cracking rendering the sample unusable.

Furthermore, with gas heating, the crucible was not heated evenly with the bottom becoming hotter than the top. The uneven heating resulting in longer fusion times to melt the flux on the upper edge of the crucible which, in turn, caused the bottom of the crucible to be heated to an unnecessarily high temperature. The heat gradient also tended to cause the flux to stick to the upper portion of the crucible when pouring the molten sample into a casting dish or acid solution.

Finally, in the existent machines used for preparation of X-ray fluorescence samples, it is desired to controllably cool the sample melt once poured into the casting dish. This has been accomplished in the past by utilizing a separate fan or air control delivery system which directs air over the casting dish for cooling. It would be far better if the thermal mass of the environment could be reduced to speed the cooling process.

SUMMARY OF THE PRESENT INVENTION

The system of the present invention provides an entirely new apparatus for the preparation of a sample for analysis by providing an electrical resistance heated oven in which the crucible and casting dish can be heated and maintained so that both go through the same heating and cooling temperature profile. A sample can be melted in the crucible and then poured into the casting dish at the same temperature to substantially eliminate any thermal shock to the sample. The electrical power to the oven can then be turned off to enable the sample to cool to produce an optimum sample for subsequent analysis.

For those analytical techniques in which the molten sample is poured into an aqueous acidic solution, the sample can be controllably melted in a crucible held within the electrical resistance heated oven. The crucible and contained molten sample can then be moved from the oven, while still held by the crucible holder, to the container with aqueous acidic solution. The crucible can then be turned to pour the sample into the acid solution.

In both the situations described, the sample and crucible are both controllably uniformly heated so that all of the sample will tend to flow to the bottom of the crucible for mixing. Since the crucible is uniformly heated the molten sample will tend to freely pour over the edge of the crucible, when tilted, enabling substantially all of the sample to leave the crucible without the need for wetting agents or heating the side of the crucible from which the molten sample pour is to be made.

These and other features and advantages of the invention will become apparent upon reading the following description thereof taken together with reference to the accompanying drawings in which:

DETAILED DESCRIPTION OF THE PREFERRED EMBODIMENTS

Figure 1:
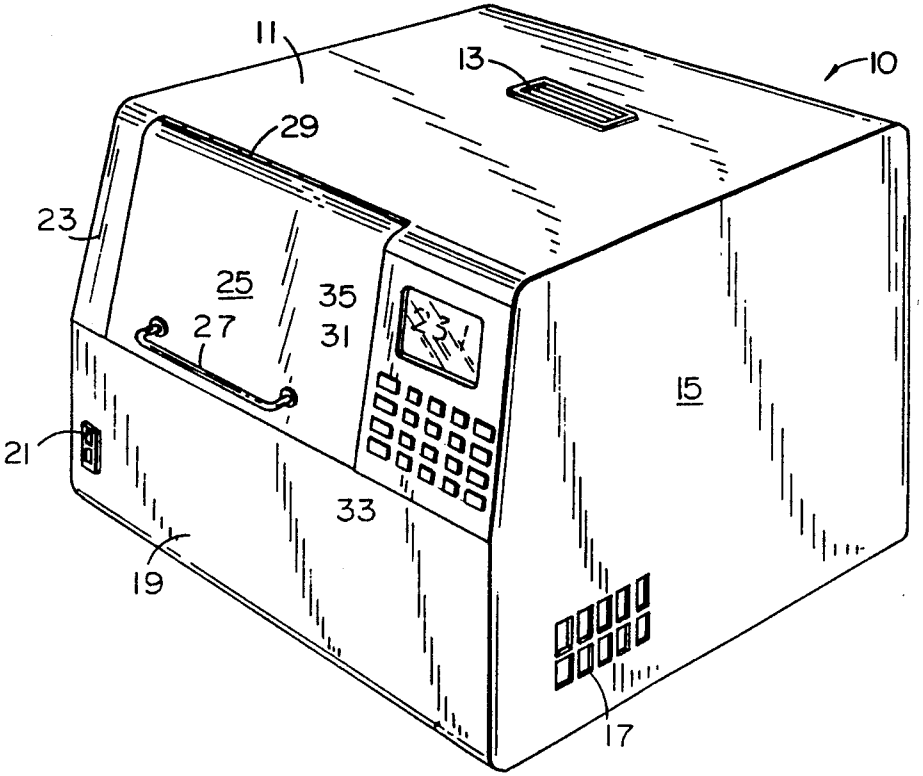
FIG. 1 is a perspective view of the electrical resistance heating apparatus.

Referring to FIG. 1, the outer configuration of the sample preparation appartus of the present invention is indicated by the number 10. The apparatus has a top cover 11 with an exit air vent 13. The right side panel 15 has an air intake vent 17 for allowing air to enter into the cabinet to circulate upwardly through the portion of the cabinet where the electronic components are contained and then to exit from vent 13 on the top of the cabinet. The face of the cabinet has a lower panel 19 which includes the main power on/off switch 21. A sloping panel 23 extends from panel 19 to top surface 11 and includes a door 25 having a handle 27. Door 25 is attached to the upper surface of the cabinet by an elongated hinge 29. On the upper right portion of the front of the apparatus is a sloping panel 31 which contains the control keypad 33 through which the apparatus function, time and temperature can be entered. Above keypad 33, and adjacent thereto for easy observation, is a digital display 35. The display can be used to show the commands, time and temperature being entered and can also display the temperature, time and step of operation of the apparatus while a sample is being prepared.

Sample preparation apparatus 10 employs electrical resistance heaters to provide the high temperature for melting the sample. Since a combustible gas mixture, such as propane and oxygen, is not employed in the apparatus, the venting formally required to remove the combustion products is no longer necessary. A simplified venting system (not shown) can be used to remove any fumes generated by a sample being melted.

Figure 2:
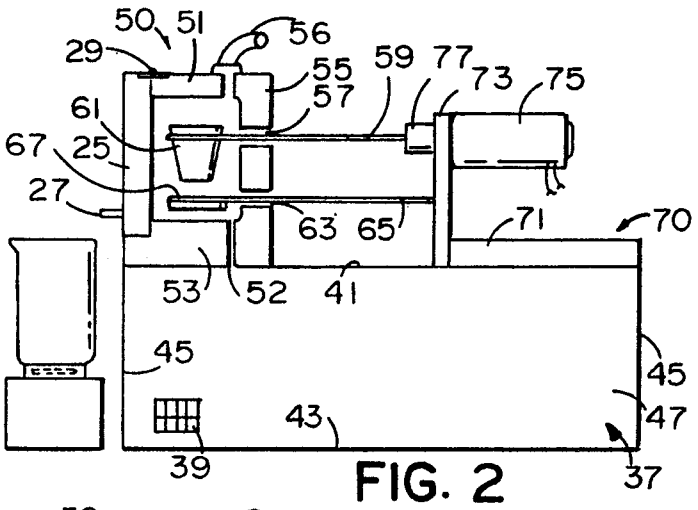
FIG. 2 is a simplified schematic view of the electrical resistance heating apparatus with the cover removed.
Figure 3:
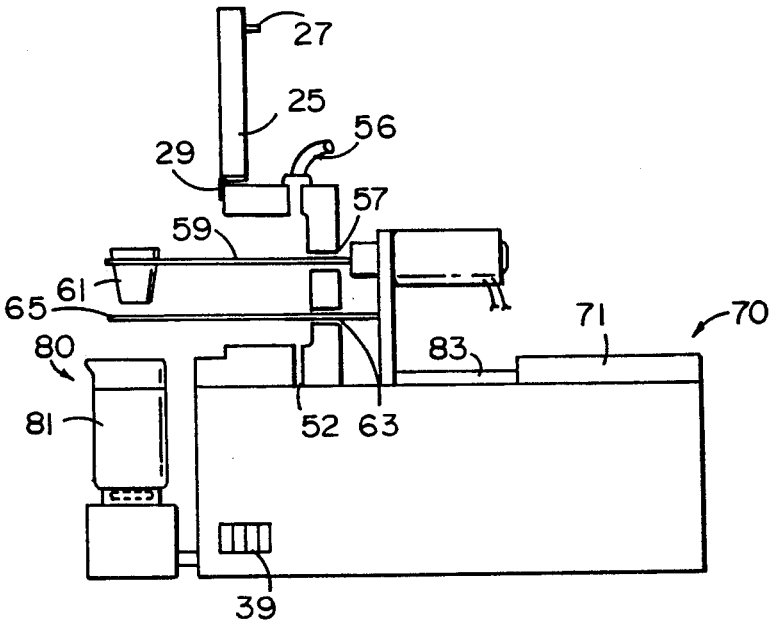
FIG. 3 is a simplified schematic view similar to FIG. 2 showing the crucible in position to pour a molten sample into a container of aqueous acidic solution.

Turning now to FIGS. 2 and 3, a simplified schematic representation is made of the several components of the apparatus. The apparatus has a supporting base enclosure 37 which has a vent 39 aligned with vent 17 in the outer cover. Vent 39 allows cooling air which entered through vent 17 to enter into base enclosure 37. Enclosure 37 is substantially in a rectangular box-like configuration having an upper surface member 41, a lower surface member 43, end members 45 and side members 47 (only one of which is shown) completing the enclosure.

On upper surface 41 of the base enclosure is mounted an electrical resistive heated oven 50. Oven 50 has a top 51, a bottom 53, a back panel 55 and side panels (not shown) which complete a substantially box-like structure. Each component of the oven is made of a block of electrical and thermal insulating material which is preferably a mixture of a glass fiber and a ceramic powder material. The fibrous ceramic molded material is available from Leco of Augusta, Georgia. The material is very light in weight and has excellent insulating properties. Door 25 is attached to top member 51 by hinge member 29. Door member 25 has a handle 27 for opening the front panel for gaining access to the interior of the electrical resistive heated oven.

Back member 55 has an upper aperture 57 through which the crucible holder 59 extends to support crucible 61. Aperture 57 is large enough to provide for crucible holder 59 to move for mixing the sample contained in crucible 61. A second aperture 63 is provided in back member 55 through which casting dish support 65 can pass. Casting dish 65 supports a ceramic casting dish 67 below crucible 61.

Figure 2A:
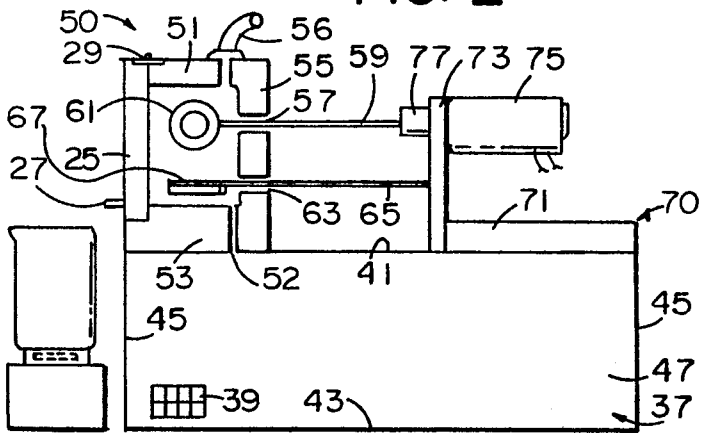
Figure 3A:
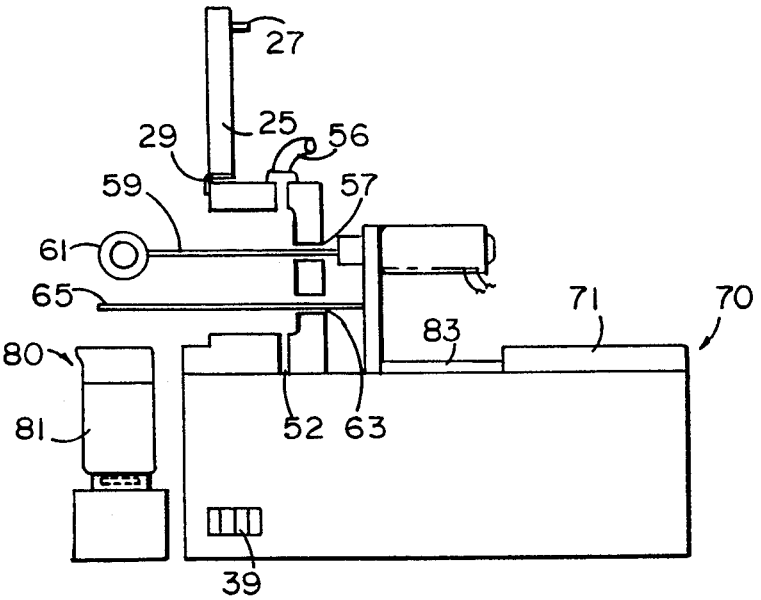
FIG. 3A is a simplified schematic similar to FIG. 3, with the crucible shown rotated 90 degrees to pour the molten sample into a container of aqueous acidic solution.

An actuator 70 is on the upper surface 41 of enclosure 37. Actuator 70 has an enclosure 71 from which a driver 83 can move to extend crucible 61 and casting dish 67 outside of oven 50, as shown in FIG. 3. Casting dish support member 65 is attached to a vertical support member 73 by any suitable connection such as a threaded joint or silver soldered joint. Vertical member 73 supports an electric motor 75 which operates through a gear assembly 77 to provide motion to stir the contents of crucible 61. The gear assembly 77 is also used to rotate crucible 61 90° to pour the contents of the crucible into casting dish 67 (FIG. 2A), or when extended outside of oven 50 and no casting dish is in place, into a beaker 80 containing an aqueous acidic solution 81 (FIG. 3A).

Actuator 70 can be a solenoid, a gear drive such as a rack and pinion or, since the movable support is in either one of two position, a pneumatic cylinder. The solenoid is the preferred actuating member in view of the total electrical nature of the sample preparation apparatus. As shown in FIG. 3, a solenoid having an extendible piston rod 83 can be contained within enclosure 71.

Figure 4:
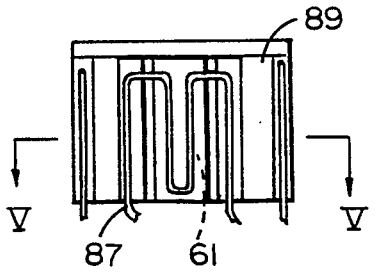
FIG. 4 is an elevational view of a wall of the oven showing an electrical resistance heating element with the phantom outline of a crucible in front of the heating element.
Figure 5:
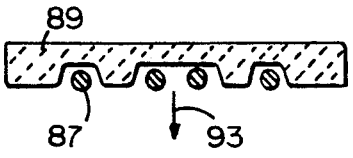
FIG. 5 is a sectional view of the oven wall of FIG. 4 taken along the line V—V.
Figure 6:
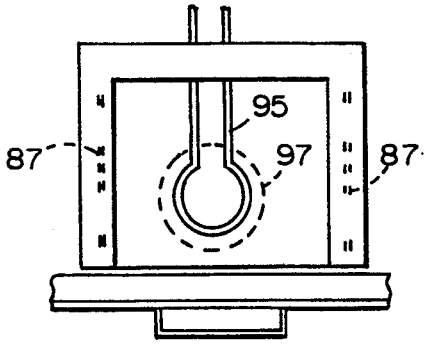
FIG. 6 is a schematic plan view showing a resistance heating element at the bottom of the oven.

Turning now to FIG. 4, a resistive heating element 87 is shown mounted in a side member 89 of the oven. Each electrical resistive heating element is preferably made of molybdenum disilicide and is configured to closely correspond to the area 91 which represents a crucible supported in the oven. The molybdenum disilicide heating elements are available from Kanthal Corporation of Bethel, Conn. Referring now to FIG. 5, heating element 87 is recessed into the surface of insulating wall member 89 so that extraneous heat radiated by the sides and back of the heating element is confined by the insulation so that the heating element directs its radient energy, as shown by arrow 93, directly at the side of the crucible. A heating element 67 can be positioned on both sides of the oven in order to maximize the heat directed at the crucible. A heating element 95 (FIG. 6) is also preferably positioned below the space occupied by crucible 61, which is indicated by a circular dash pattern 97. Heater 95 is preferably recessed in the surface of insulating base member 53 so that the major component of the heat produced is directed upward in the direction of the crucible.

Referring to FIG. 2, oven 50 can be seen to be not much larger than necessary to contain crucible 61 and casting dish 67. Since there is no reason to vent combustion gases from the oven, it is no longer necessary to install the fluxer in a conventional fume hood. A small amount of air can be allowed to flow into the oven through a port 52 in bottom 53 to purge fumes from the melting sample into an exhaust vent 56 in top 51 of the oven. The exhaust vent can be connected to an exhaust port in the laboratory. It is preferred to build the apparatus of the present invention in a modular form with one oven for each crucible. The apparatus can then be expanded by adding the number of modules desired. It is clearly within the scope of the present invention to provide a single oven large enough to contain more than one crucible; however, the aforedescribed modular construction is preferred. Also, since the primary means of heating the crucible is by radiant energy, a heater similar to heater 87 or 95 can be disposed in upper member 51 of oven 50 to direct radiant energy downwardly directly at the sample and the interior of crucible 61.

Figure 7:
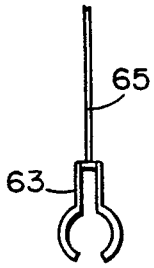
FIG. 7 is a plan view of a crucible and casting dish holder.

A representative casting dish holder 63 is shown in FIG. 7. The casting dish holder has a pair of spaced thin flexible jaws made from a metal alloy such as Inconel which is a high nickel content stainless steel. It is preferred to reduce the size of the crucible and casting dish holder in order to reduce the thermal mass to be heated and cooled within the oven.

Figure 8:
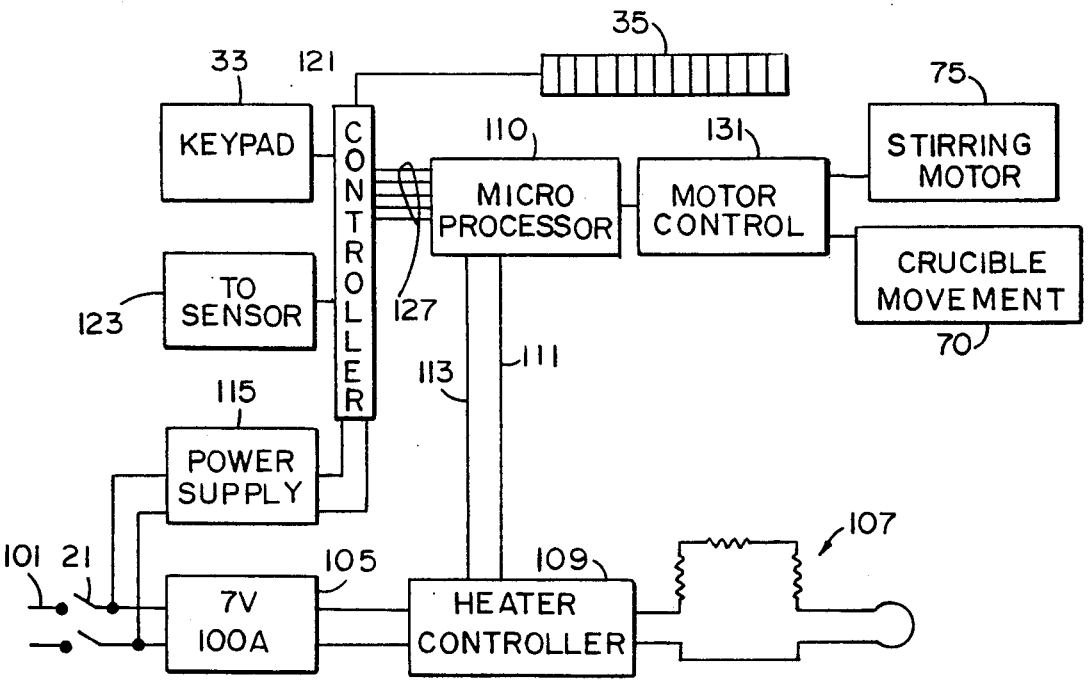
FIG. 8 is an electrical schematic, in block diagram form, of the electronic circuitry of the sample preparation apparatus.

The electrical circuitry for controlling the apparatus of the present invention is shown in FIG. 8. A suitable source of electric power 101 is connected through a switch 21 to a step-down transformer 105 which provides approximately 7 volts at 100 amperes for the series connected heating elements indicated generally by 107. As mentioned previously, the preferred material for the heating elements is molybdenum disilicide. This material is capable of producing a substantial amount of heat and, on initial heating, a portion of the silicone in the heating element tends to melt forming a glass-like coating on the heating element, thereby protecting the heating element from oxidation by the ambient air contained within the oven. The series connected heaters exhibit low resistance upon initial application of the electrical power. In order to reduce the substantial surge current, a heater controller 109 is employed which limits the amount of current drawn by the individual heaters until their thermally generated internal resistance is sufficient to accept the applied power. The preferred heater controller can be a conventional soft start circuit which limits the width of the positive and negative alternating current pulses applied until the resistance increases. Other conventional soft start devices can be used, for example, a resistive element which has a high initial resistance which decreases upon heating similar to a filament in an incandescent light bulb. As mentioned above, the preferred means for limiting the current supplied to the heating elements is the soft start circuitry which is controlled by output signals from microprocessor 110 on conductors 111 and 113. The input electric power is also supplied to a low voltage power supply 115 which produces an output of approximately 5 volts, which is suitable for operating the solid state devices employed in the electronic circuitry.

A controller 121 receives input signals from digital keypad 33 for setting the time and temperature desired during the sample preparation process. The controller also receives an input from a suitable temperature sensing device 123, such as a thermocouple or thermister. Controller 121 delivers and receives digital data from a bi-directional data bus 127 which is connected between controller 121 and microprocessor 110. Microprocessor 110 can be any of the well-known Intel family of microprocessors. In view of the limited number of functions controlled by the microprocessor, an Intel 8088 device has ample capability. The use and programming of this device is well-known.

For automatic operations, keypad 33 can be used to enter the time and temperature and control functions which can be viewed on digital display 35. As the sample preparation process takes place, microprocessor 110 can monitor the temperature sensing devices 123 and through its internal clock can calculate the time.

An output of microprocessor 110 can be used to drive motor control 131 which, in turn, controls the stirring 133 and crucible movement 135 which are implemented by electric motor 75 and gear drive 77 and actuator 70, respectively.

The resistive heating elements provide more uniform heating of the casting dish. Also, the casting dishes can reach a higher temperature with less energy because of the insulation surrounding the heating elements. A distinct advantage of the electric resistive heating sample preparation apparatus is that the casting dishes can cool more quickly since there is less thermal mass, presented by the oven, to cool.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modification.

The embodiments of the invention in which an exclusive property or privilege is claimed are defined as follows.

1. An apparatus for the preparation for analytical samples comprising:

a frame member;

an oven on said frame member, said oven having a top member and a bottom member joined together by opposite side members and a back member to form an enclosed structure having an open front;

a door member pivotally attached to said oven member for reversibly opening and closing the front of said oven;

at least one resistive heating element in said oven;

a crucible holder slidably mounted through a wall of said oven;

a casting dish holder slidably mounted through a wall of said oven; and a movable support member for said crucible holder and said casting dish holder, said movable support member being adapted to hold a crucible and a casting dish in said oven during the melting of a sample in a crucible and the subsequent pouring of the molten sample into a casting dish.

2. An apparatus for the preparation of a sample as set forth in claim 1, wherein top, bottom, side, back and door of said oven are all made of insulatinq material.

3. An apparatus for the preparation of a sample as set forth in claim 2, wherein said insulating material is a mixture of glass fibers and ceramic.

4. An apparatus for the preparation of a sample as set forth in claim 3, wherein said insulating material is a fibrous ceramic material.

5. An apparatus for the preparation of a sample as set forth in claim 1, wherein said at least one resistive heating element is positioned on the bottom of said oven with the surface of said at least one heating element exposed to the inside of said oven.

6. An apparatus for the preparation of a sample as set forth in claim 1, wherein a plurality of resistive heating elements are disposed on the inner surfaces of said oven.

7. An apparatus for the preparation of a sample as set forth in claim 6, wherein said plurality of resistive heating elements are connected in a series electrical circuit.

8. An apparatus for the preparation of a sample as set forth in claim 1, wherein said back member of said oven has an aperture therein for said crucible support, said aperture enabling said crucible support to move to mix a molten sample in a crucible.

9. An apparatus for the preparation of a sample as set forth in claim 1, including a motor on said support member for moving said crucible holder to mix a sample therein and to rotate said crucible holder to pass a molten sample from a crucible.

10. An apparatus for the preparation of a sample as set forth in claim 9, including an assembly driver by said motor, said assembly enabling a crucible supported by said crucible holder to mix a sample while in said oven.

11. An apparatus for the preparation of a sample as set forth in claim 10, wherein said assembly can cause said crucible holder to pass the molten contents of a sample in a supported crucible into a container.

12. An apparatus for the preparation of a sample as set forth in claim 11, wherein said container is a heated casting dish in said oven.

13. An apparatus for the preparation of a sample as set forth in claim 11, wherein said container is a receptacle positioned external to said oven, said receptacle containing a solution into which a sample can be poured from a crucible.

14. An apparatus for the preparation of a sample as set forth in claim 1, wherein said movable support member can move said crucible holder and a supported crucible out of said oven where the contents of the crucible can be poured into a container.

15. An apparatus for the preparation of a sample as set forth in claim 1, including a motor means for moving said movable support member.

16. An apparatus for the preparation of a sample as set forth in claim 15, wherein said motor means is a solenoid mounted on said frame, said solenoid being operatively connected to said support member for moving said crucible support out of said oven.

17. An apparatus for the preparation of a sample as set forth in claim 15, wherein said motor means is a rack member operatively mounted on said frame and a pinion member coupled to said rack member for moving said rack member and said movable support member.

18. An apparatus for the preparation of a sample as set forth in claim 15, wherein said insulating material is configured to receive said resistive heating element substantially covering the back and sides of said heating element leaving the front exposed for the direct heating of a crucible in said oven.

* * * * *

UNITED STATES PATENT AND TRADEMARK OFFICE

CERTIFICATE OF CORRECTION

PATENT NO. : 5,315,091

DATED : May 24, 1994

INVENTOR(S) : O'Brien et al.

It is certified that error appears in the above-indentified patent and that said Letters Patent is hereby corrected as shown below:

Col. 1, line 15:
After "methods" insert --.--.

Col. 2, line 31:
Insert --FIG. 2A is a simplified schematic similar to FIG. 2, with the crucible rotated 90 degrees to pour the contents of the crucible into a casting dish;--.

Col. 6, line 19:
"insulatinq" should be --insulating--.

Signed and Sealed this

Twentieth Day of December, 1994

*Attest:*

Bruce Lehman

BRUCE LEHMAN

*Attesting Officer*

*Commissioner of Patents and Trademarks*